US010640350B2

(12) United States Patent
Härtel et al.

(10) Patent No.: US 10,640,350 B2
(45) Date of Patent: May 5, 2020

(54) METHOD FOR CLEANING AND/OR DISINFECTING SEALING ELEMENTS, SEALING MACHINE, AND SEALING ELEMENT

(71) Applicant: KHS GmbH, Dortmund (DE)

(72) Inventors: Manfred Härtel, Weilerbach (DE); Michael Beisel, Schöneberg (DE); Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 265 days.

(21) Appl. No.: 15/749,852

(22) PCT Filed: Jun. 15, 2016

(86) PCT No.: PCT/EP2016/063719

§ 371 (c)(1),
(2) Date: Feb. 2, 2018

(87) PCT Pub. No.: WO2017/021043

PCT Pub. Date: Feb. 9, 2017

(65) Prior Publication Data

US 2018/0215598 A1 Aug. 2, 2018

(30) Foreign Application Priority Data

Aug. 4, 2015 (DE) ..... 10 2015 112 790

(51) Int. Cl.

| | |
|---|---|
| ***B67B 3/00*** | (2006.01) |
| ***B67B 3/10*** | (2006.01) |
| ***B67B 1/04*** | (2006.01) |

(52) U.S. Cl.

CPC ..... *B67B 3/003* (2013.01); *B67B 1/04* (2013.01); *B67B 3/10* (2013.01); *B67B 2201/08* (2013.01)

(58) Field of Classification Search

CPC .. B67B 3/003; B67B 3/10; B67B 3/00; B67B 2201/08; B67B 1/03

USPC ..... 53/425, 432, 510

See application file for complete search history.

(56) References Cited

U.S. PATENT DOCUMENTS

| | | | | |
|---|---|---|---|---|
| 4,419,376 | A * | 12/1983 | Hersom | B65B 43/60 426/402 |
| 4,987,726 | A * | 1/1991 | Petho | B67C 3/04 53/281 |
| 6,351,924 | B1 * | 3/2002 | Gustafsson | A61L 2/186 53/425 |
| 9,187,304 | B2 * | 11/2015 | Kampmann | B67B 3/2013 |
| 9,233,820 | B2 * | 1/2016 | Bernhard | B67B 3/2033 |
| 9,302,896 | B2 * | 4/2016 | Drenguis | A61L 2/087 |
| 9,340,310 | B2 * | 5/2016 | Knieling | B67B 3/2033 |
| 9,434,592 | B2 * | 9/2016 | Niehr | B67C 3/22 |

(Continued)

FOREIGN PATENT DOCUMENTS

| | | |
|---|---|---|
| DE | 32 27 244 | 1/1984 |
| DE | 41 15 285 | 1/1992 |

(Continued)

*Primary Examiner* — Gloria R Weeks

(74) *Attorney, Agent, or Firm* — Occhiuti & Rohlicek LLP

(57) ABSTRACT

Cleaning a sealing element includes pausing a rotor that bears the sealing elements at an angle from a set of discrete angles such that a sealing element is brought to a cleaning station. The station's coupling piece connects to the sealing element and allows cleaning medium to flow into it.

18 Claims, 11 Drawing Sheets

(56) References Cited

U.S. PATENT DOCUMENTS

| | | | | |
|---|---|---|---|---|
| 9,745,183 | B2 * | 8/2017 | Jakob | B67B 3/02 |
| 9,915,628 | B2 * | 3/2018 | Pawlowicz | G01N 23/2255 |
| 10,328,167 | B2 * | 6/2019 | Geslot | A61L 2/26 |
| 2012/0055115 | A1 * | 3/2012 | Preti | B67B 3/10 53/342 |
| 2015/0246801 | A1 * | 9/2015 | Niehr | A61L 2/20 422/28 |
| 2017/0362070 | A1 * | 12/2017 | Pagliarini | B67B 3/20 |
| 2018/0170601 | A1 * | 6/2018 | Krakers | B65B 55/025 |
| 2018/0208445 | A1 * | 7/2018 | Danelski | A61L 2/26 |
| 2018/0215598 | A1 * | 8/2018 | Hartel | B67B 3/10 |
| 2019/0248636 | A1 * | 8/2019 | Caffa | B67B 3/2033 |

FOREIGN PATENT DOCUMENTS

| | | |
|---|---|---|
| DE | 196 26 680 | 1/1998 |
| DE | 299 18 679 | 3/2001 |
| DE | 603 04 103 | 12/2006 |
| DE | 10 2011 102 090 | 11/2012 |
| WO | WO92/05104 | 4/1992 |

* cited by examiner

METHOD FOR CLEANING AND/OR DISINFECTING SEALING ELEMENTS, SEALING MACHINE, AND SEALING ELEMENT

RELATED APPLICATIONS

This is the national stage under 35 USC 371 of international application PCT/EP2016/063719, filed on Jun. 15, 2016, which claims the benefit of the Aug. 4, 2015 priority date of German application DE 10 2015 112 790.3, the contents of which are herein incorporated

FIELD OF INVENTION

The invention relates container processing, and in particular, to sealing elements.

BACKGROUND

After filling a container, it is usual to seal the container with a seal. A variety of seals are known, including corks, crown caps, screw closures, sealing covers, and sealing caps. A sealing machine usually handles the seals. These sealing machines must be periodically cleaned and disinfected.

A sealing machine typically has many regions that are difficult for a cleaning fluid to reach. To clean such regions, it is necessary to disassemble the machine. This is time-consuming because sealing machines or sealing assemblies are often arranged in a line with a filling machine or with a filling assembly and with other sealing machines or sealing assemblies. In most cases, they are difficult to physically access.

It is possible to design the sealing machine to have permanent connections that lead to difficult-to-clean portions thereof. Cleaning medium can then be passed through the connections and directed to clean these areas. However, this requires complex design.

SUMMARY

It is an object of the invention to promote more intensive internal cleaning of the sealing elements of a sealing assembly, and in particular an intensive internal cleaning and/or disinfecting with an operating mode that is reliable and simplified.

According to the invention, the sealing machine or sealing assembly, or the rotor carrying its sealing elements, are driven by a drive, for example a servo or direct drive, which is not only independent of the driving of other assemblies or machines such as the filling machine or filling assembly of an installation but which also makes it possible during normal production operations, i.e. during the filling and sealing of the containers, to rotate this rotor continuously and synchronously with the installation's other machines and assemblies, and with which the rotor carrying the sealing elements can still be controlled to rotate incrementally or cyclically in the cleaning mode. Only in this way is it possible in cleaning mode to move the sealing elements individually or in groups in which the number of sealing elements is much less than the total number of sealing elements of the sealing assembly, each group comprising at least two sealing elements, in chronological succession to a docking or cleaning station where, during the standstill phase of the cycled motion of the rotor, the treatment of the respective sealing element present at the cleaning station is carried out, for example by a free feeding of the cleaning media to the positioned sealing stations or for example by automatic or mechanical coupling of at least one coupling piece of the cleaning station for the delivery of the cleaning medium, including for the internal cleaning of the sealing element concerned, by then opening the feed line of the cleaning medium, by discharging the cleaning medium after it has flowed through the treated sealing element, including through the latter's interior chamber, by then closing the feed line for the cleaning medium after the treatment time so as to end the treatment, and by the automatic or mechanical uncoupling of the coupling piece from the sealing element concerned.

The sealing elements are therefore treated singly or in groups in chronological succession during the cleaning mode. The cleaning mode is ended when all sealing elements have been treated with the cleaning medium. During the treatment, the sealing element, and in particular its interior, as well as its sealing tools are flushed around or flushed through repeatedly with interruptions, or continuously, and/or are treated with the cleaning medium.

The docking or cleaning station is only active during the cleaning mode. If the installation is in production mode, the docking or cleaning station is without function and so does not interfere with normal production. In particular, the docking or cleaning station does not disturb the rotation of the sealing machine or sealing assembly.

In a simplified embodiment, after the cleaning medium has flowed through the interior chamber of the sealing elements and around the sealing tools it flows off freely downward and is caught preferably in a collecting dish or tray from where it can flow away through a return. Alternatively, the cleaning medium can be returned to the CIP system or to the storage tank.

In a preferred embodiment, the cleaning medium is not only delivered but is also discharged through a coupling piece, either through a common coupling piece, which has a feed line and a discharge line, or through two coupling pieces. The coupling piece used to discharge the cleaning medium is also automatically coupled to and uncoupled from the respective sealing element and also forms part of the cleaning station. The coupling is typically a mechanical coupling.

The automatic coupling and uncoupling of the coupling piece to and from the respective sealing element is effected, for example, by a robot, by a manipulator controlled by a drive, or by a linear-motion drive of the cleaning station.

The cleaning medium is a liquid, vaporous and/or gaseous medium. The treatment can generally also be carried out using a plurality of different media and preferably in chronological sequence.

During treatment, the cleaning medium flows through the sealing element concerned preferably downwards from above. For this purpose, the cleaning or disinfecting medium is fed preferably to an upper region of the interior chamber of the sealing element and discharged from a lower region of the sealing element.

As used herein, "container" refers to bottles or cans made of metal, glass and/or plastic, as well as other packaging materials suitable for being filled with liquid or viscous products.

As used herein, the expressions "essentially", "in essence" or "around" mean variations from the respective exact value by ±10%, preferably by ±5% and/or variations in the form of changes insignificant for the function.

As used herein, "cleaning medium" means a "cleaning and/or disinfecting medium." A cleaning medium can be liquid or gas, including a vaporous gas such as steam.

As used herein, "cleaning mode" means cleaning and/or disinfecting mode.

As used herein, "cleaning mode" includes CIP cleaning mode.

As used herein, "cleaning station" means "docking or cleaning station."

As used herein, "sealing assembly" refers to both a sealing machine and a sealing assembly.

BRIEF DESCRIPTION OF THE FIGURES

These and other features of the invention will be apparent from the following detailed description and the figures, in which.

DETAILED DESCRIPTION

Figure 1:
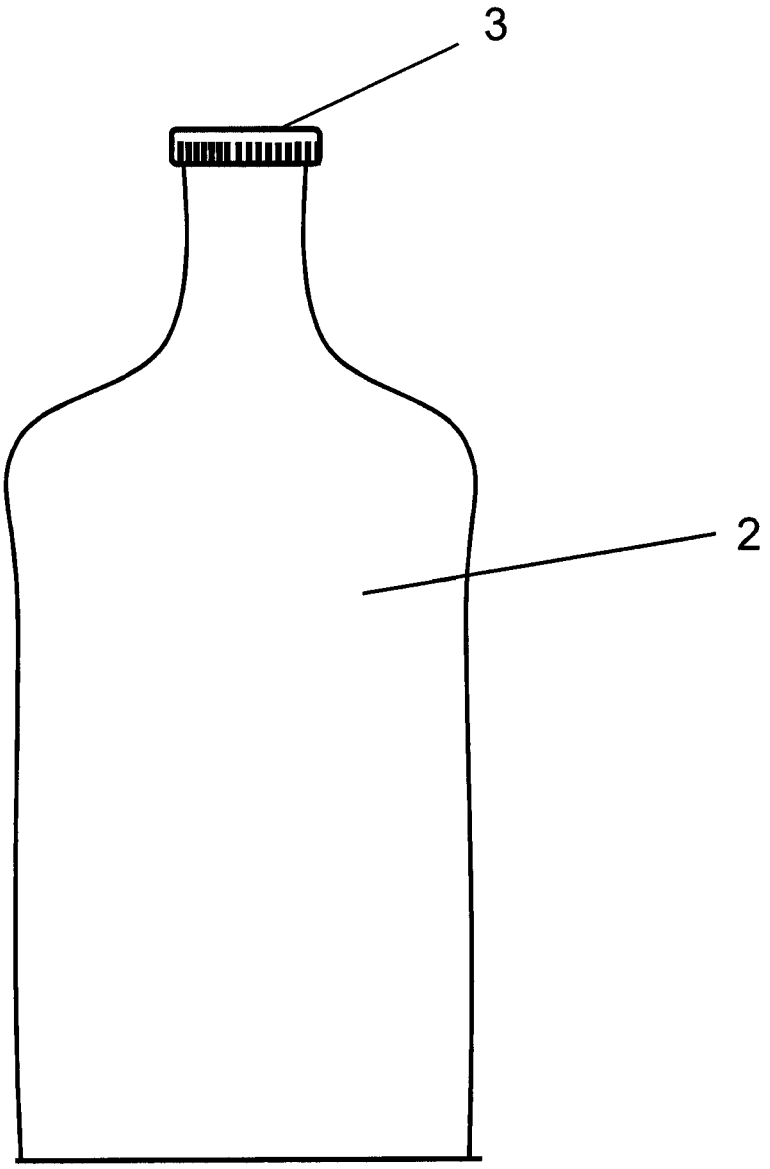
FIG. 1 shows a bottle sealed with a crown cap.

FIG. 1 shows a container 2 that has been sealed by a closure 3. An example of a container 2 is a bottle. An example of a closure 3 is a crown-cap seal.

Figure 2:
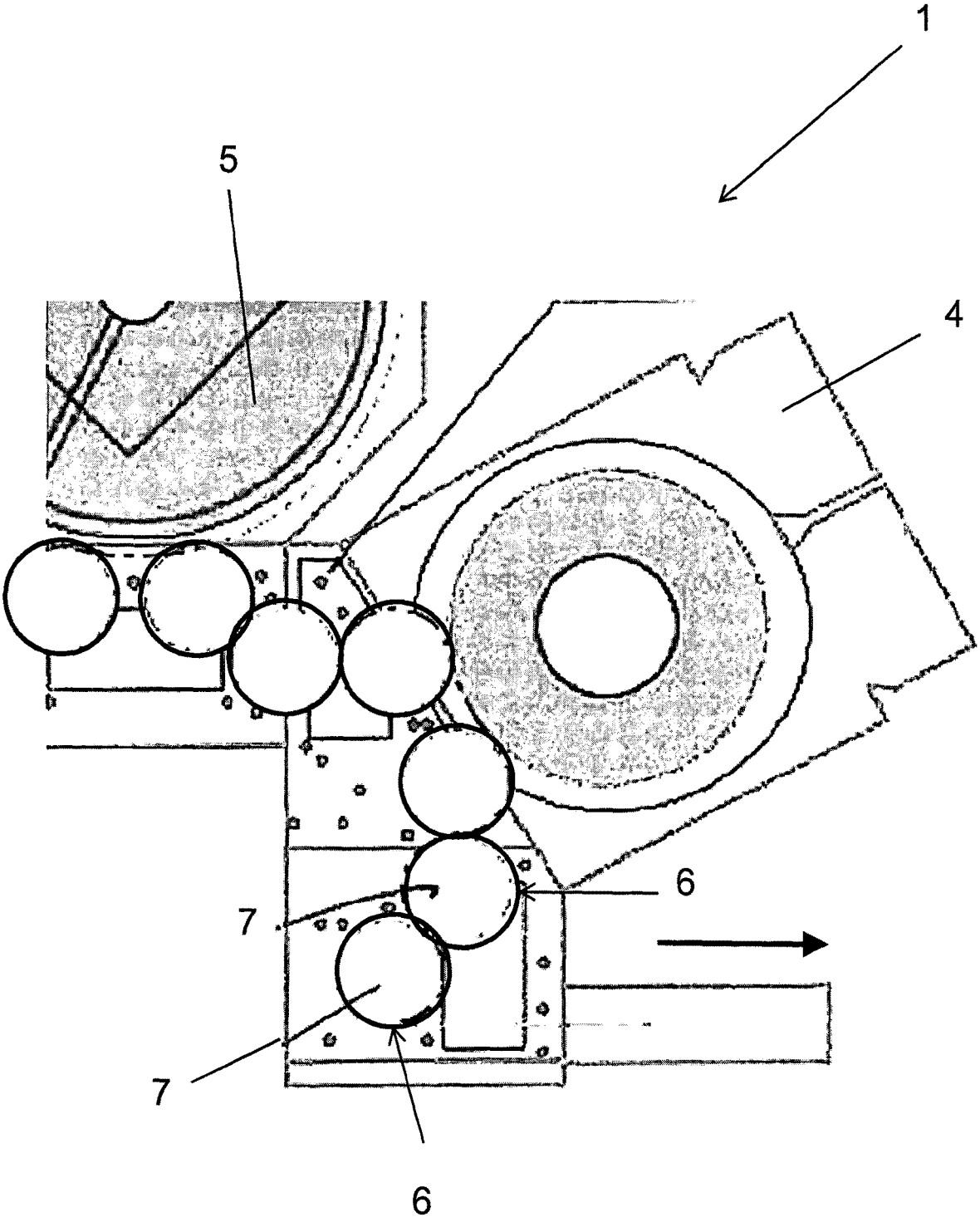
FIG. 2 shows a view from above a filling and sealing installation for processing the bottle shown in FIG. 1.

FIG. 2 shows an installation 1 for processing the container 2 shown in FIG. 1. The installation 1 includes a rinsing machine 5, a filling assembly 4, a sealing assembly 6, and an ejection star. Some embodiments have multiple sealing assemblies 6 configured for processing different seals, with one sealing assembly 6 being configured to process the crown caps while another sealing assembly 6 processes screw caps.

Figure 3:
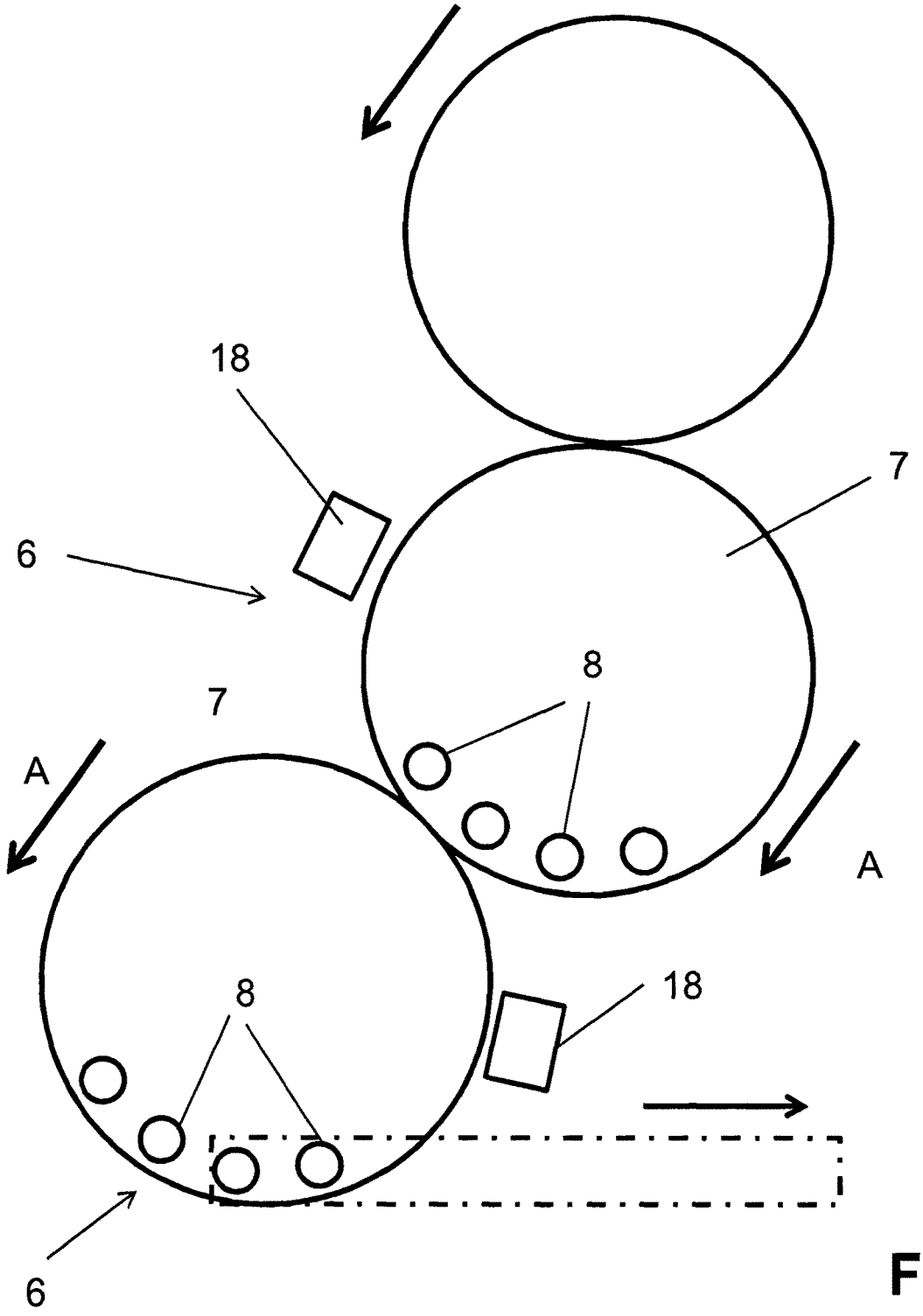
FIG. 3 shows two sealing assemblies that follow the filling assembly show in FIG. 2.

Referring now to FIG. 3, the sealing assembly 6 includes a rotor 7 that rotates about a vertical machine-axis in a rotation direction A. Disposed around the rotor's periphery are sealing elements 8 that are separated from each other by a pitch distance.

Figure 4:
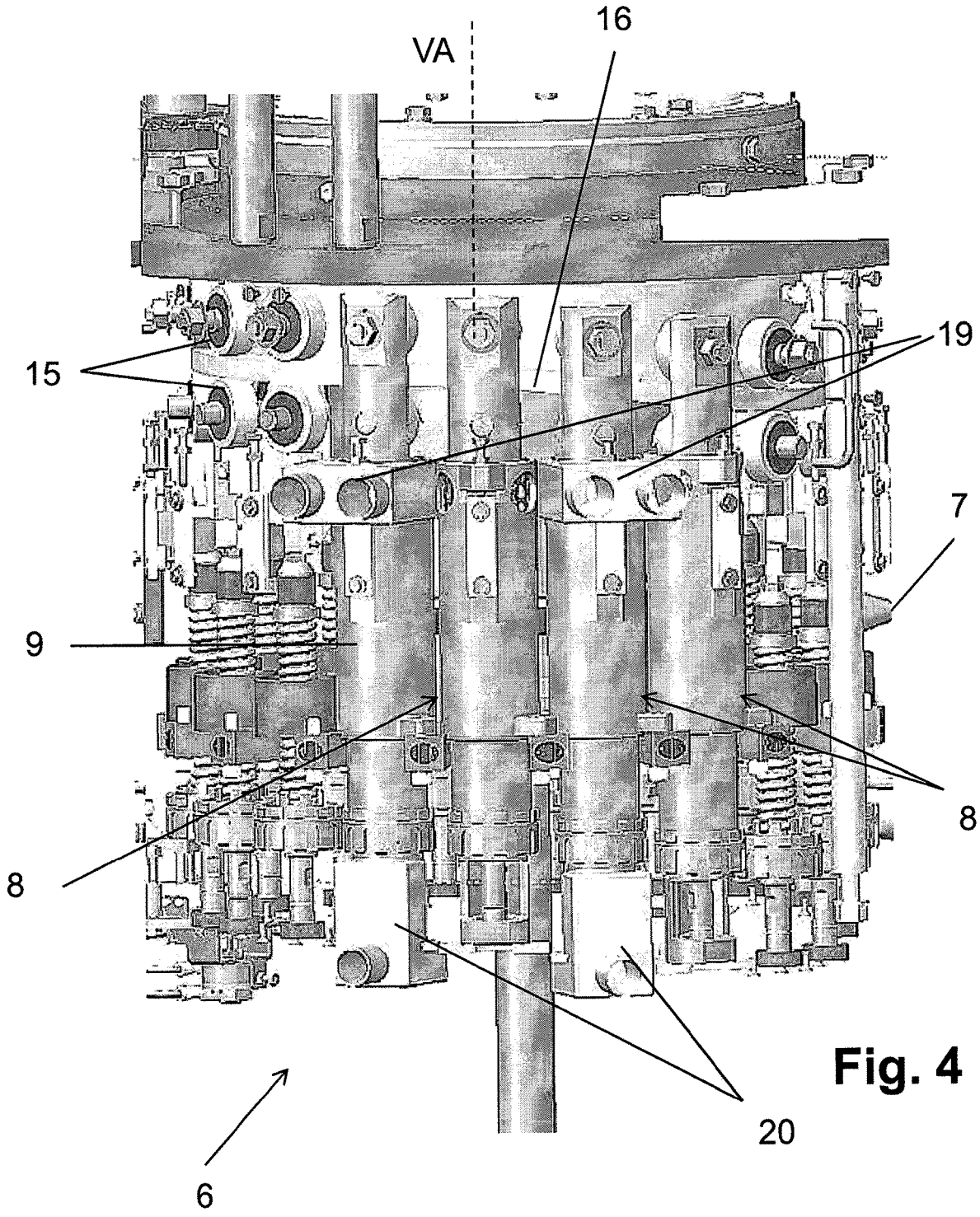
FIG. 4 shows a partial side view of one of the two sealing assemblies of the installation of FIG. 2.
Figure 5:
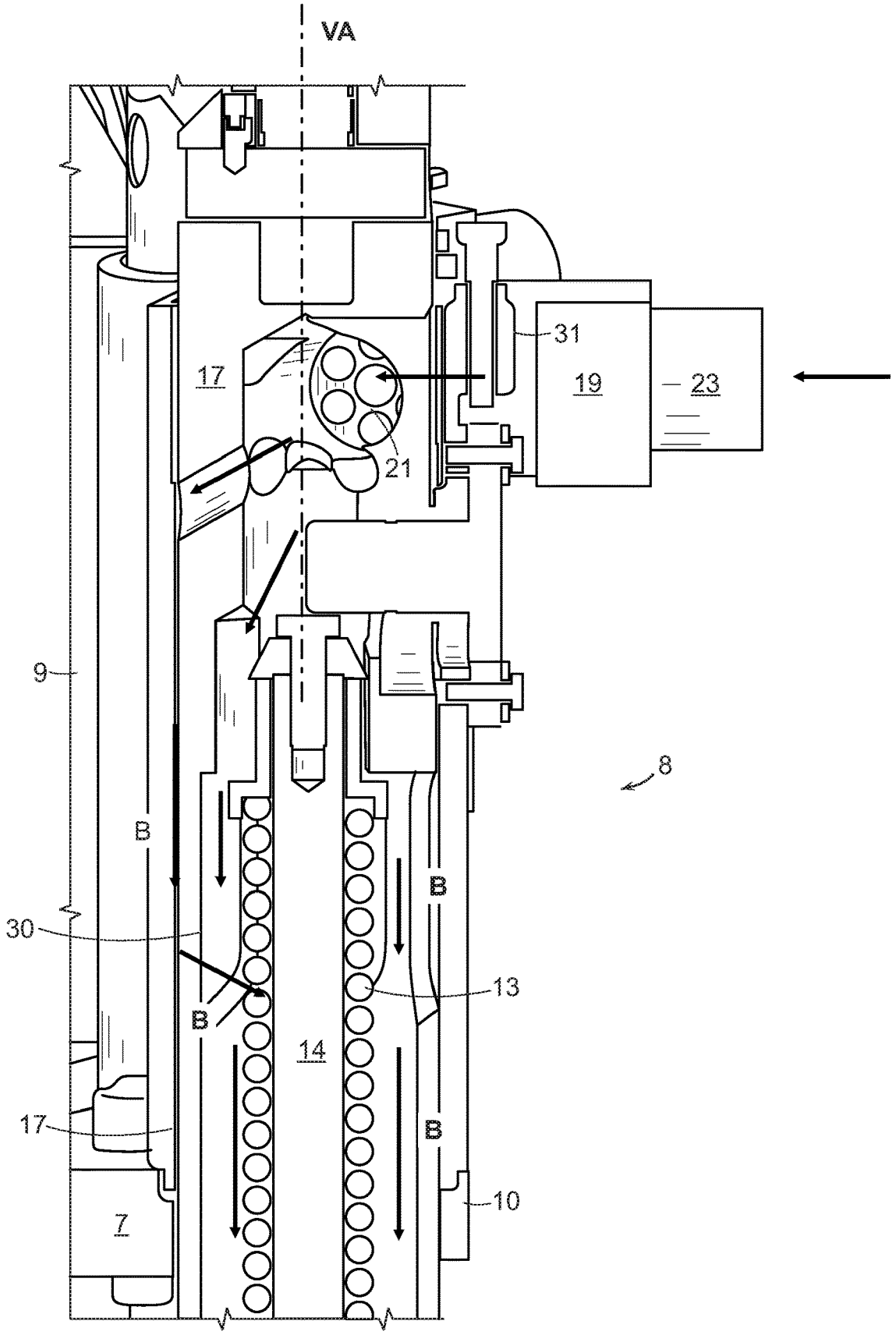
FIG. 5 shows a longitudinal section through the upper region of a sealing element together with a connecting or coupling piece for feeding a cleaning medium used for internal cleaning of the sealing element.

Each sealing element 8 has a sleeve-like guide bearing 9 as shown in FIG. 4. The rotor 7 holds the guide bearing 9 and orients it coaxially with a sealing-element axis VA that is oriented parallel to the rotor's axis of rotation of rotor 7. A pressure cylinder 10 extends coaxially with the sealing-element axis VA and moves axially for some travel distance, as shown in FIG. 5. This configuration permits the sealing element 8 to process crown caps.

Figure 6:
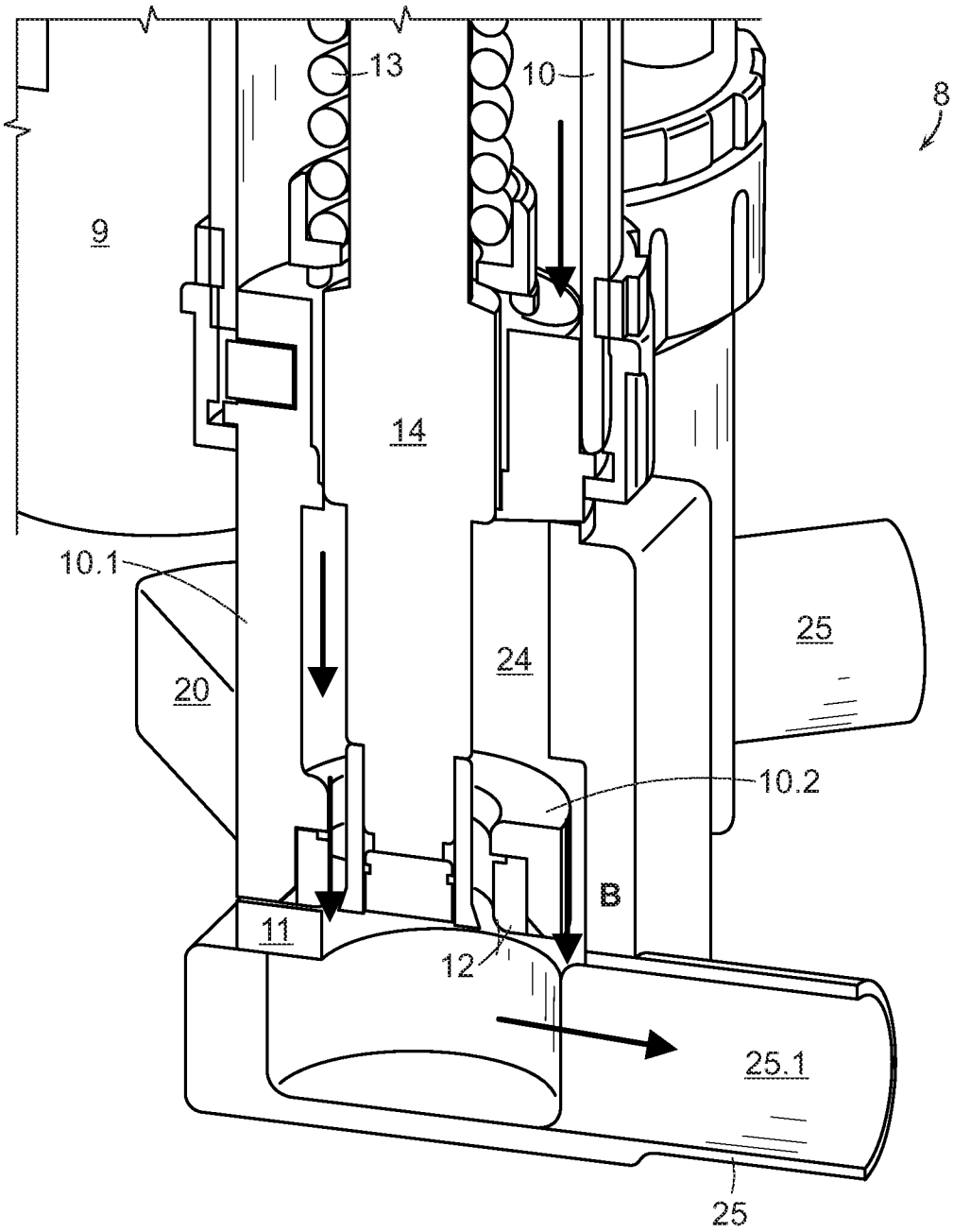
FIG. 6 shows a longitudinal section through the lower region of the sealing element of FIG. 5 together with a cap-like connecting or coupling piece mounted on the sealing element to discharge the cleaning medium.

Referring to FIG. 6, a plate 11, such as a cork shoe, is disposed at the lower end of a shoe-like extension 10.1. The plate 11 holds a pulling ring 12 at the lower end of the shoe-like extension 10.1 or at an annular section 10.2 located at the lower end of the shoe-like extension 10.1.

Within the pressure cylinder 10 is a compression spring 13 that spring loads a stem-shaped holding-down device 14. The holding device 14 is coaxial with the sealing-element axis VA and moves with the pressure cylinder 10.

The pulling ring 12 has a sprayed-on seal that prevents dirt and bacteria from penetrating the gap between pulling ring 12 and the annular section 10.2 that holds the pulling ring 12. The retaining plate 11 also has a sprayed-on seal that seals off the gap between the retaining plate 11, the pulling ring 12 and the show-like extension 10.1.

When the rotor 7 rotates, the sealing element 8 accepts a closure 3 at a closure-transfer position. A magnet holds this closure at the lower end of the holding-down device 14. The closure 3 is then set down onto a container 2 that is beneath sealing element 8.

Controlled downward movement of the pressure cylinder 10 and of the holding-down device 14 carries out the container-closing process. The process begins with the holding-down device 14 pressing the closure 3 against the container's opening. The pulling ring 12 then deforms the closure 3 and thus fixes it to the container 2.

Referring to FIG. 4, during container closing, a control cam 16 controls movement of the pressure cylinder 10 via cam rollers 15 that are arranged on the pressure cylinder 10. These cam rollers 15 interact with the control cam 16.

The guide bearing 9 also houses the pressure cylinder 10 along an upper part of its length and guides it as it engages in vertical motion. A seal 17 seals the lower end of the pressure cylinder 10. The holding-down device 14 and the pulling ring 12 form the actual sealing tool of sealing element 8.

Referring back to FIG. 3, the sealing assembly 6 includes a cleaning station 18 along the path traversed by the sealing elements 8. The cleaning station 18 does not rotate with either rotor 7 or with the sealing elements 8 located on rotor 7.

The cleaning station 18 includes upper and lower coupling-pieces 19, 20. The upper coupling-piece 19 can be seen in FIGS. 5, 7, and 8. The lower coupling-piece 20 can be seen in FIGS. 6 and 9.

When the sealing assembly operates in cleaning mode, the upper and lower coupling-pieces 19, 20 permit treatment of the whole interior chamber of each sealing element 8 with a cleaning medium that flows through the interior chamber and over and around all the surface regions of the pulling ring 12 and the holding-down device 14.

Figure 7:
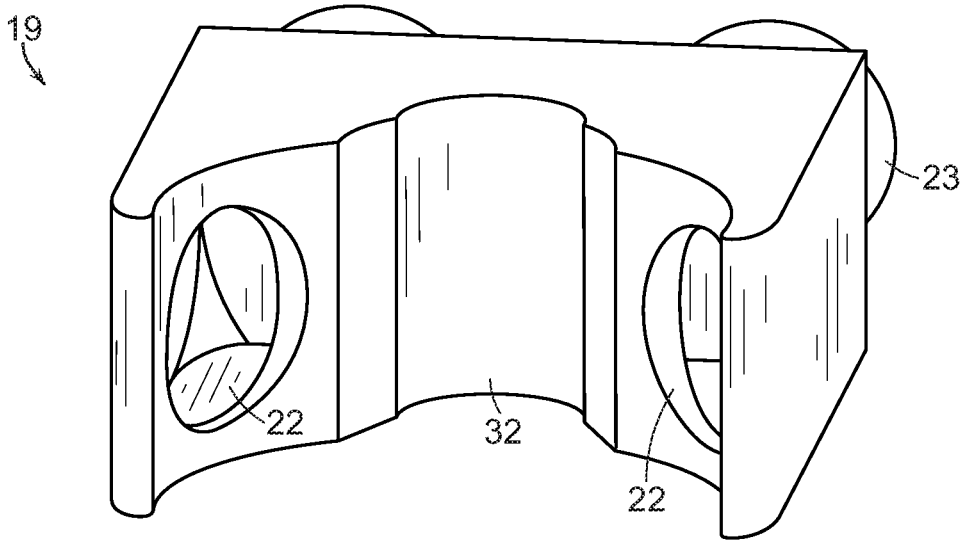
FIGS. 7 and 8 show perspective cross-sectional views of the coupling piece for feeding the cleaning medium.
Figure 8:
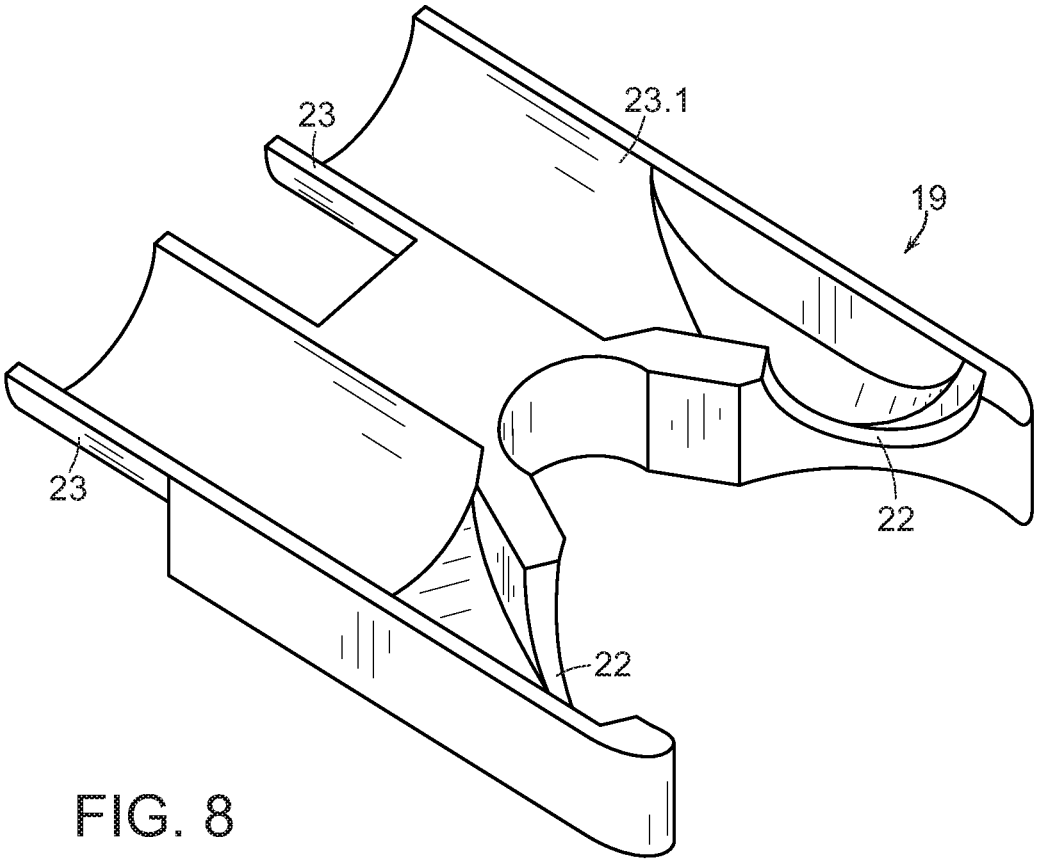

The upper coupling-piece 19, shown in FIGS. 5 and 7, is configured so that its radial motion relative to the sealing-element axis VA presents it to the upper end of the sleeve-like guide bearing 9 in such a way that the upper coupling-piece 19 straddles the guide bearing 9 on its cylindrical outer surface relative to sealing-element axis VA. The angular range of the straddled portion is greater than 90° but less than 180°, as shown in FIG. 4.

Coupling occurs in part through first and second pairs of connection ports 21, 22 that coincide with each other. The first pair of connection ports 21 is associated with the upper coupling-piece 19. The second pair of connection ports 22 is associated with the guide bearing 9. As a result, upon connecting the upper coupling-piece 19, the first and second pairs of connection ports 21, 22 establish a flow connection out of a pair of channels 23.1 that is associated with first pair of connection ports 21 from connections 23 of the upper coupling-piece 19 and into the interior of guide bearing 9.

Relative to sealing-element axis VA, the first and second pairs of connection ports 21, 22 are offset from one another by an angle greater than 90°, for example by an angle of approximately 120°. To achieve a tightly sealed transition between the upper coupling-piece 19 and the housing 9 in the region of the first and second pairs of connection ports 21, 22, the upper coupling-piece 19 has a sprayed-on seal at the place where the channels 23.1 each open out into the first pair of connection ports 21.

During the cleaning mode, the lower coupling-piece 20 presents itself to the sealing element 8 by moving radially relative to sealing-element axis VA. Upon presenting itself, it interacts with the extension 10.1, which surrounds the sealing-element axis VA in the shape of part of a shell, to form a rinsing chamber 24, best seen in FIG. 6. The rinsing chamber 24 is isolated from its surroundings. Within the rinsing chamber 24 are the lower section of the holding-down device 14, the pulling ring 12, and the plate 11 that holds the pulling ring 12. A connection 25 provided on the lower coupling-piece 20 opens out by its channel 25.1 into the rinsing chamber 24.

Figure 9:
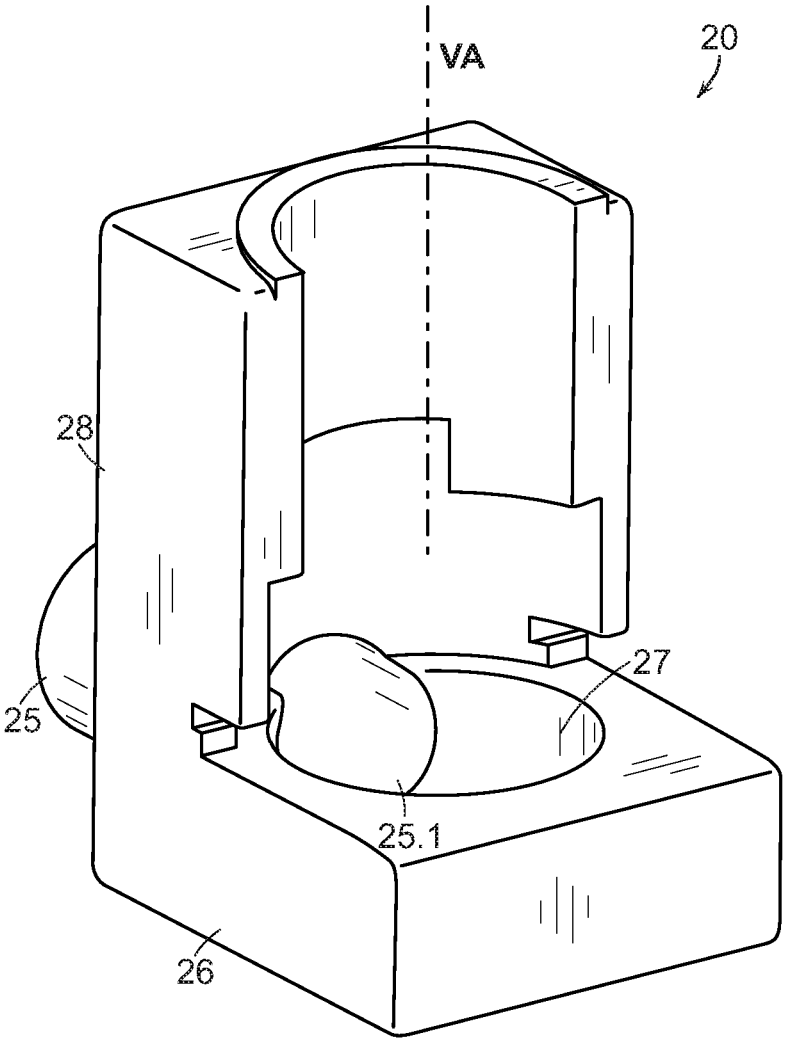
FIG. 9 shows a perspective cross-sectional view of the cap-like coupling piece for discharging the cleaning medium.
Figure 10:
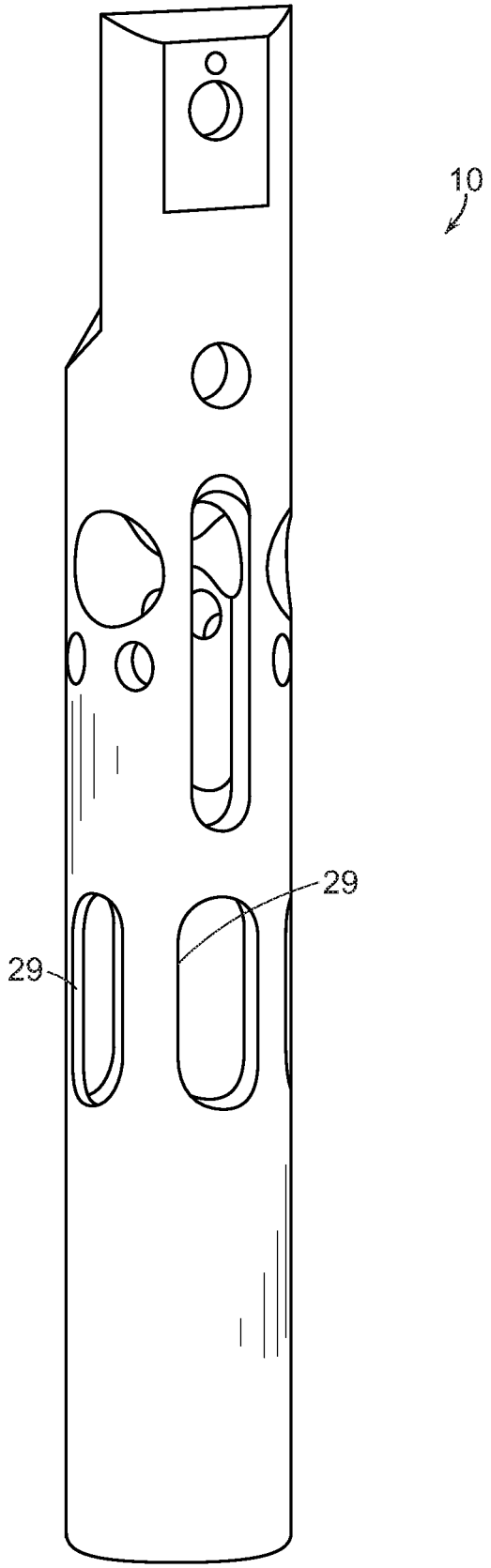
FIGS. 10 and 11 show a perspective side-view and partial section of a pressure cylinder of a sealing element.
Figure 11:
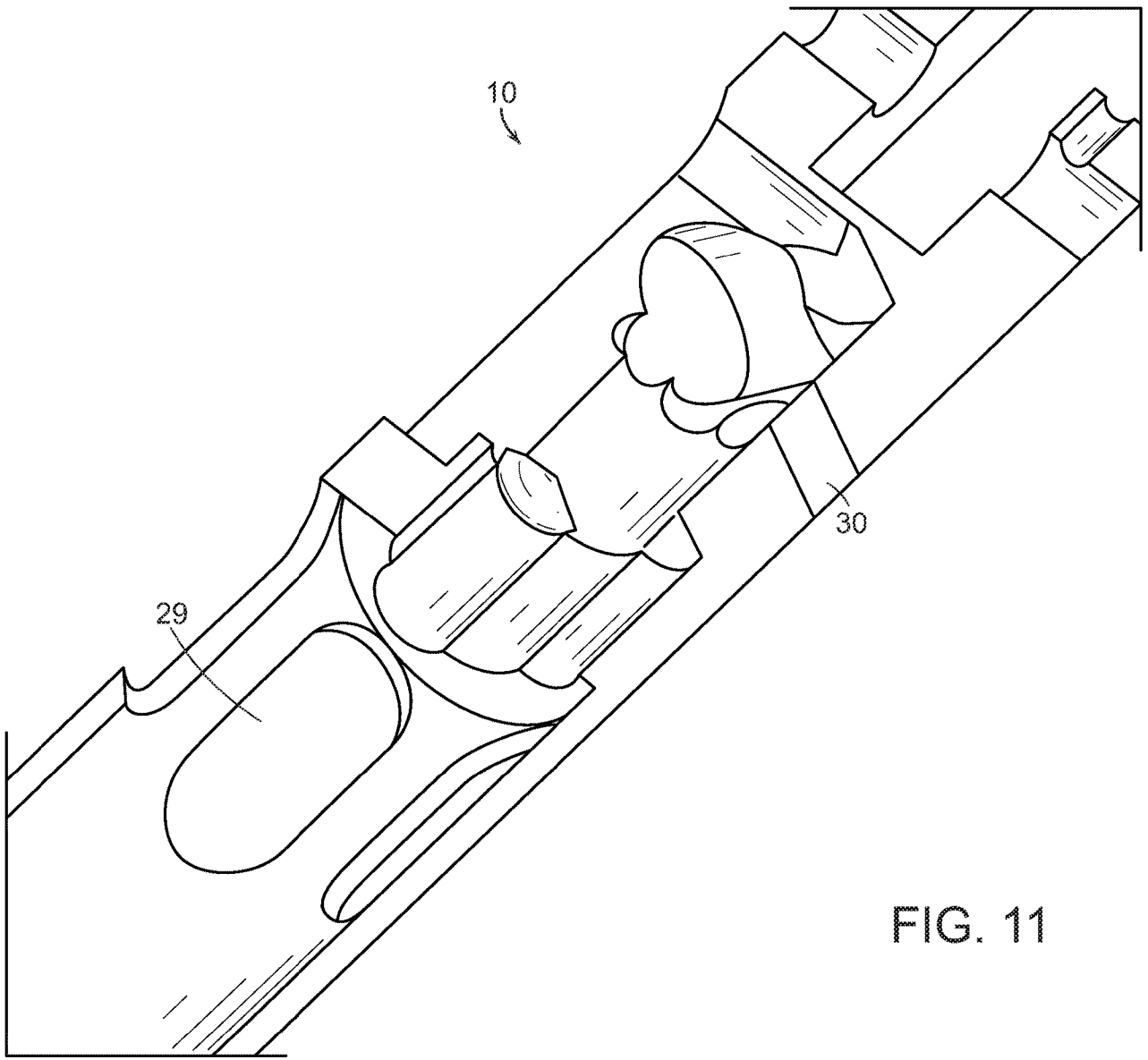
Figure 12:
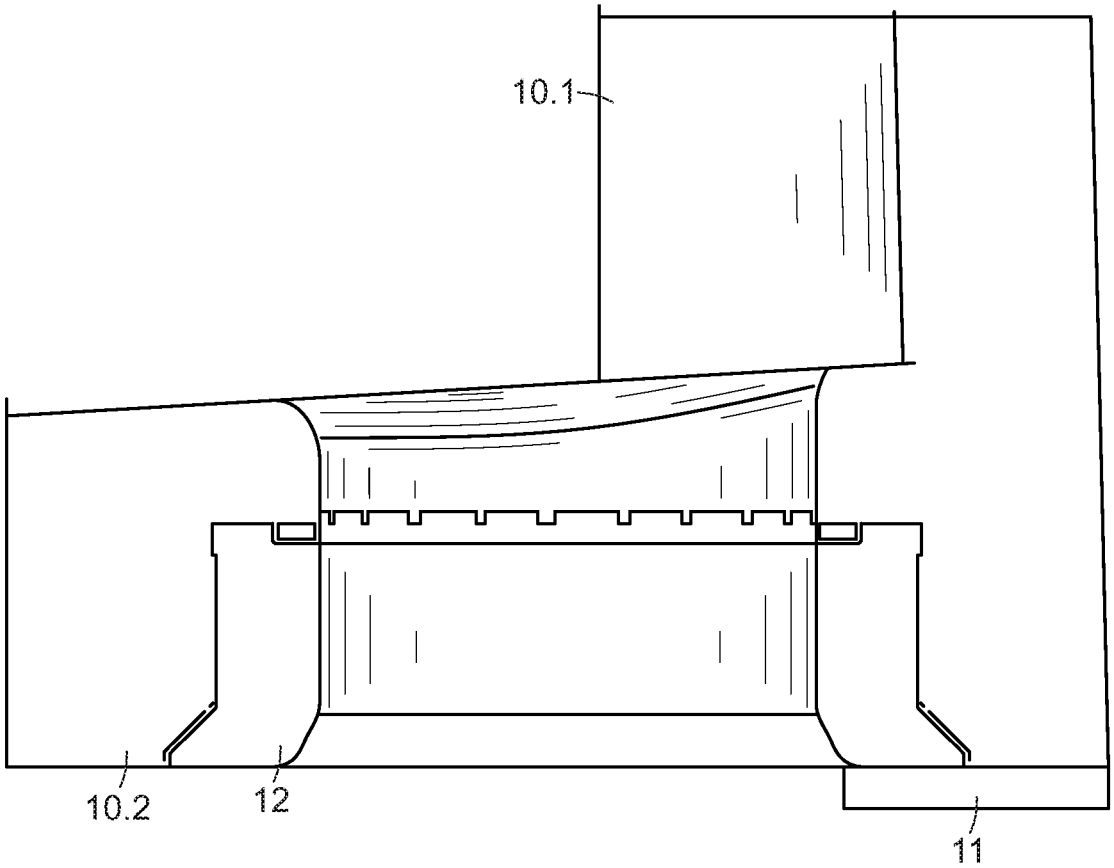
FIG. 12 shows a partial view of the lower end of the pressure cylinder with a pulling ring and a retaining plate, or cork shoe, that secures the pulling ring.

Referring to FIG. 9, the lower coupling-piece 20 has a plate-shaped base 26 having a recess 27 into which the connection's channel 25.1 opens out. A half-shell section 28 extends above the base's surface on the side at which the recess 27 opens. Its concave side, which faces the recess 27, defines a curved arc about an axis perpendicular to the base's surface. Extending the coupling piece 20 makes this axis coaxial with sealing-element axis VA. On a surface side and on the edge faces of the half-shell section 28, the coupling piece 20 has a preferably sprayed-on seal so that extending the coupling piece 20 seals the rinsing chamber 24 from the outside.

Multiple openings 29 and flow channels 30 in the pressure cylinder 10 form a multi-branch flow path B for cleaning medium. During internal cleaning, the multi-branch flow path B permits cleaning medium to flow through more than just the interior of the pressure cylinder 10 and along the functional elements therein. The multi-branch flow path B formed by the flow channels 30 also permits cleaning medium to flow through all those regions of the sealing element 8 that are important to clean. This includes the gap between the inner face of guide bearing 9 and the outer face of the pressure cylinder 10. It also includes the guide faces that are formed between the holding-down device 14 and the pressure cylinder 10.

During cleaning mode, the cleaning medium flows through the sealing element 8 from top to bottom. It then passes through the two connections 23 of the upper coupling-piece 19 and discharges through the connection 25 of the lower coupling-piece 20.

To promote a swirl in the cleaning medium's flow, and to establish such a swirl as soon as possible after the cleaning medium enters the sealing element 8, it is useful for the two connection ports 22 to each be formed by individual openings. In some embodiments, an adjustable panel has these individual openings.

Cleaning mode takes place in a sequence of steps such that the sealing assembly's drive moves each sealing element 9 into a cleaning position in which it is immediately adjacent to the cleaning station 18. To achieve this, the sealing assembly 6 has a drive that transitions between normal mode and cleaning mode. During normal mode, when containers are being filled, the drive drives the rotor 7 continuously and synchronously with the filling assembly 4. During the cleaning mode, the drive drives the rotor 7 discontinuously in discrete steps. Each step moves a point on the rotor's periphery by one pitch distance. This pitch distance is the distance between adjacent sealing elements on the rotor 7.

Once a sealing element 8 is positioned at the cleaning station 18, the upper and lower coupling-pieces 19, 20, which until now have been arranged outside the trajectory of sealing elements 8 couple to sealing element 8. The connections 23 at the upper coupling-piece 19 and the connection 25 at the lower coupling-piece 20 form a sealed connection with the interior chamber of sealing element 8 through which the cleaning medium then flows in the multi-branch flow path B.

After treating a sealing element 8, the upper and lower coupling-pieces 19, 20 return to their starting position. The drive then rotates rotor 7 by one pitch. The entire procedure then repeats for the next sealing element 8.

The upper and lower coupling pieces 19, 20 move automatically with no manual intervention by an operator. In some embodiments, a robot, manipulator, or linear-motion drive effects such movement. The entire cleaning mode of the sealing assembly 6, which includes moving sealing elements 8 to cleaning position 18, presenting and removing of the upper and lower coupling pieces 19, 20 to and from sealing elements 8, as well as beginning and ending feeding of the cleaning medium, is controlled by an electronic control device. As a result, no manual intervention by operators is needed at any time during the cleaning mode.

A direct drive with a servo-motor, in particular with a torque motor that facilitates a precise step-by-step rotation of the rotor 7 with no delay, is suitable as a drive for driving the rotor 7 of the sealing assembly 6.

Referring to FIG. 5, a positioning aid 31 promotes the exact positioning of the upper coupling-piece 19 at a sealing element 8. The positioning aid 31 is associated with a coupling section 32 of the upper coupling-piece 19, as shown in FIG. 7. The coupling section 32 is complementary to the outer contour of its associated positioning aid 31. As a result, engagement of the positioning aid 31 and the coupling section 32 guarantees exact position of the upper coupling-piece 19 at the sealing element 8.

It has so far been assumed that, during the cleaning mode, sealing elements 8 are treated one-at-a-time and one-after-the-other. However, in other embodiments, the cleaning station 18 simultaneously treats all sealing elements in a group of sealing elements. In such embodiments, the number of upper and lower coupling pieces 19, 20 corresponds to the number of sealing elements 8 to be treated in each group. Alternatively, each upper and lower coupling piece 19, 20 simultaneously couples to two or more sealing elements 8. After the sealing elements 8 of a group have been treated, the rotor 7 moves by one step that corresponds to the angular distance between the sealing-element groups.

The invention has so far been described using the example of a sealing assembly 6 or sealing elements 8 configured for processing crown-cap closures. The invention is also suitable for sealing assemblies for processing other types of closures. In this case, each sealing elements 8 forms an interior chamber through which the cleaning medium can flow and that can be connected to coupling pieces for feeding and/or discharging the cleaning medium but that is otherwise closed to its surroundings, again, for example, one of the coupling pieces being configured in the shape of a cap or part of a cap and forming a rinsing chamber in which the actual sealing tool of the sealing element is arranged and around which the cleaning medium flows intensively during the cleaning mode.

The apparatus described herein treats the sealing elements either individually or in groups in chronological sequence during step-by-step rotation of the rotor 7 that carries the sealing elements and with the mechanical presentation, to the sealing elements, of coupling pieces that are used to feed the cleaning medium and preferably also to discharge the cleaning medium, also with the mechanical removal of the coupling pieces from the sealing elements, with the entire process taking place automatically, controlled by an electric or electronic controller, for example by the installation's controller.

It has so far been assumed that lower coupling-pieces 20 are used as a return for discharging the cleaning medium. In a simplified embodiment, it is also possible to feed the cleaning medium through the presented upper coupling-piece 19 into the interior chamber of the sealing element and drain it away downwards either freely or into a collection dish so as to be able to dispense with lower coupling-piece 20.

It may also be an advantage for connection ports 21 through which the cleaning medium is fed to be self-closing, i.e. so that these connection ports 21 are only opened when a coupling piece 19 is presented or so that the connection ports 21 are only opened by the coupling piece 19.

During treatment of each sealing element 8 with different cleaning media, it may be advantageous to feed each cleaning medium through a separate upper coupling-piece 19 and to then discharge it through a separate lower coupling-piece 20, at least in those cases in which lower coupling pieces 20 are used.

The coupling pieces, which are for the different cleaning media, are all active at different rotational positions of the rotor 7. When the rotor 7 stands still, each sealing element 8 is treated first with a first cleaning medium. Then, when the rotor 7 steps forward into a new position, each sealing element 8 is treated with a second cleaning medium. In some embodiments, the first cleaning medium is liquid and the second cleaning medium is gas. However, this can also be reversed.

By treating sealing elements 8 in chronological sequence, either individually or in small groups, it is possible to provide treatment station 18, and the at least one coupling piece for sealing assembly 6, only once and to design it so that it only occupies a small angular range of the rotary motion of rotor 7, so that treatment station 18 does not restrict normal production operations (filling and sealing the containers) but the cleaning of sealing elements 8 in particular is still made possible without complex assembly/dismantling work. Cleaning station 18 is preferably arranged within an angular range of the rotary motion of rotor 7 formed between a container exit and a container entry.

The invention claimed is:

1. A method comprising cleaning a first sealing element from a plurality of sealing elements, wherein cleaning said first sealing element comprises cleaning said sealing element with a first cleaning medium, wherein cleaning with said first cleaning medium comprises, during a cleaning mode, feeding a first cleaning medium through a first coupling piece so that said first cleaning medium flows through an interior chamber of said first sealing element, around a functional element located in said interior chamber, and around a sealing tool used to apply a closure to a container, wherein cleaning said first sealing element comprises, causing a rotor that bears said sealing elements to pause during rotation thereof at an angle from a set of discrete angles such that said rotor rotates step-by-step until said first sealing element has been brought to a cleaning station that comprises said first coupling piece, causing said first coupling piece to connect to said first sealing element, and, upon completion of treatment, mechanically removing said first coupling piece from said first sealing element.

2. The method of claim 1, further comprising discharging said first cleaning medium out of said first sealing element through a second coupling piece of said cleaning station, wherein said discharging comprises mechanically coupling said second coupling piece to said first sealing element and mechanically removing said second coupling piece after having completed treatment of said first sealing element with said first cleaning medium.

3. The method of claim 2, wherein, while said first and second coupling pieces are coupled to said first sealing element, one of said coupling pieces forms a rinsing chamber that accommodates said sealing tool.

4. The method of claim 2, wherein cleaning said first sealing element further comprises causing said rotor to rotate to a subsequent angle from said discrete set of angles and to pause at said subsequent angle, thereby bringing said first sealing element to said subsequent angle, and, after having done so, cleaning said first sealing element with a second cleaning medium.

5. The method of claim 1, wherein cleaning said first sealing element comprises causing an electronic controller to execute a stored program that controls said cleaning mode.

6. The method of claim 1, wherein at least one of causing said first coupling piece to connect to said first sealing element, and, upon completion of treatment, mechanically removing said first coupling piece from said first sealing element comprises causing said first coupling piece to move along an axial direction thereof, wherein causing said first coupling piece to move along said axial direction comprises causing said axial direction to move in a direction that is radial to a sealing-element axis of said sealing element.

7. The method of claim 1, wherein at least one of causing said first coupling piece to connect to said first sealing element, and, upon completion of treatment, mechanically removing said first coupling piece from said first sealing element comprises causing said movement to be effected by a structure selected from the group consisting of a robot, a manipulator, and a linear-motor drive.

8. The method of claim 1, wherein feeding said first cleaning medium comprises causing said first cleaning medium to flow through a connection port and using said first coupling piece to open said connection port and to close said connection port.

9. An apparatus comprising a sealing assembly, wherein said sealing assembly comprises a plurality of sealing elements mounted on a rotor and a cleaning station, wherein said cleaning station is disposed on a trajectory of said sealing elements, wherein said cleaning station does not rotate with said rotor, wherein said cleaning station comprises a first coupling piece, wherein said first coupling piece is arranged at said cleaning position, wherein said first coupling piece is configured to be mechanically coupled to said sealing element prior to cleaning said sealing element, wherein said first coupling piece is configured to be mechanically decoupled from said sealing element after said sealing element has been cleaned, wherein each sealing element comprises a sealing tool, wherein said sealing assembly operates in a cleaning mode and in an operating mode, wherein, in operating mode, said sealing assembly seals containers with closures and said rotor is driven continuously about a vertical machine-axis, and wherein, in cleaning mode, said rotor is configured to be driven to rotate step-by-step about said vertical machine-axis when said sealing assembly such that said rotor pauses at each angle in a discrete set of angles and said first coupling piece feeds a first cleaning medium into said sealing element.

10. The apparatus of claim 9, further comprising, at said cleaning station, a second coupling piece, wherein said second coupling piece discharges said first medium, wherein said second coupling piece is mechanically moved for coupling and uncoupling.

11. The apparatus of claim 9, wherein said cleaning station comprises a structure for causing movement of said first coupling piece, said structure selected from the group consisting of a robot, a manipulator, and a linear-motion drive.

12. The apparatus of claim 9, wherein said closing station further comprises a second coupling piece, wherein said discrete set of angles at which said rotor pauses comprises a first angle and a second angle, wherein said first coupling piece is disposed at a first angle within said set of angles, and wherein said second coupling piece is disposed at a second angle within said set of angles.

13. The apparatus of claim 9, further comprising a machine controller that autonomously controls all sequences of the cleaning mode, wherein said machine controller controls said step-by-step rotation of said rotor, wherein said machine controller controls coupling and uncoupling said first coupling piece, and wherein said machine controller controls opening and closing of a feed line for said cleaning medium.

14. An apparatus comprising a sealing element of a sealing assembly for sealing containers with closures, said sealing element comprising a housing, a sealing tool, a first connection port, and a functional element, wherein said sealing element defines a sealing-element axis, wherein said housing defines an interior chamber, wherein cleaning medium flows through said first connection port into said interior chamber, wherein said sealing tool is disposed in said interior chamber, wherein said functional element comprises a hollow shaft, wherein said hollow shaft rotates about said sealing-element axis, wherein said hollow shaft lifts along said sealing-element axis for fixing a closure to a container, wherein said housing accommodates at least a partial length of said hollow shaft, wherein said hollow shaft comprises flow channels and openings, wherein said openings permit fluid to flow between an interior and exterior of said hollow shaft, and wherein said flow channels and openings define a branched flow path for said cleaning medium.

15. The apparatus of claim 14 wherein said sealing element is configured to process crown-cap closures and wherein said functional element comprises a pressure cylinder.

16. The apparatus of claim 14 wherein said connection port is sealed and opened automatically when said sealing assembly operates in cleaning mode.

17. The apparatus of claim 14, further comprising a second connection port for feeding a different cleaning medium, wherein said first and second connection ports are circumferentially offset about said sealing-element axis.

18. The apparatus of claim 14, further comprising a first coupling piece and a second coupling piece, wherein, when said sealing element is coupled to said first and second coupling pieces, cleaning medium enters via said first coupling piece and is discharged via said second coupling piece, wherein, during coupling to said sealing element, said first and second coupling pieces move radially toward said sealing-element axis and wherein during uncoupling from said sealing element said first said first and second coupling pieces move radially away from said sealing-element axis.

* * * * *